US007481390B2

(12) United States Patent
Reinhold

(10) Patent No.: US 7,481,390 B2
(45) Date of Patent: Jan. 27, 2009

(54) DEVICE FOR WINDING WEBS OF MATERIAL

(75) Inventor: Klaus Reinhold, Lengerich (DE)

(73) Assignee: Klaus Reinhold Maschinen- und Gerätebau GmbH, Lengerich (DE)

( * ) Notice: Subject to any disclaimer, the term of this patent is extended or adjusted under 35 U.S.C. 154(b) by 482 days.

(21) Appl. No.: 10/493,476

(22) PCT Filed: Oct. 24, 2002

(86) PCT No.: PCT/EP02/11908

§ 371 (c)(1),
(2), (4) Date: Jul. 5, 2005

(87) PCT Pub. No.: WO03/035523

PCT Pub. Date: May 1, 2003

(65) Prior Publication Data

US 2007/0057109 A1 Mar. 15, 2007

(30) Foreign Application Priority Data

Oct. 24, 2001 (DE) ..... 201 17 248 U

(51) Int. Cl.
*B65H 18/14* (2006.01)

(52) U.S. Cl. ..... 242/541.1; 242/541.4; 242/541.5; 242/541.6; 242/542.3

(58) Field of Classification Search ..... 242/541, 242/541.1, 541.4, 541.5, 541.6, 541.7, 533.2, 242/542.3

See application file for complete search history.

(56) References Cited

U.S. PATENT DOCUMENTS

| | | | | |
|---|---|---|---|---|
| 3,202,374 | A * | 8/1965 | Phelps | 242/541.1 |
| 4,744,526 | A * | 5/1988 | Kremar | 242/533 |
| 5,154,367 | A * | 10/1992 | Beisswanger | 242/541.4 |
| 5,251,835 | A * | 10/1993 | Kyytsonen | 242/533.2 |
| 5,611,500 | A * | 3/1997 | Smith | 242/541.4 |
| 5,645,245 | A * | 7/1997 | Kremar | 242/541.1 |
| 6,036,137 | A * | 3/2000 | Myren | 242/541.7 |
| 6,325,323 | B1 * | 12/2001 | Olsson | 242/541.7 |
| 6,444,093 | B1 * | 9/2002 | Luomi et al. | 162/202 |
| 6,550,713 | B1 * | 4/2003 | Ruha et al. | 242/541.7 |

* cited by examiner

*Primary Examiner*—Sang Kim
(74) *Attorney, Agent, or Firm*—Gudrun E. Huckett

(57) ABSTRACT

A device for winding film webs, paper webs and similar material webs supplied continuously across guide rollers has a counter roller in a device frame part for supplying the material web. A winding shaft that is rotatable and movably supported in the frame cooperates circumferentially with the counter roller, wherein the winding shaft is provided with a corresponding winding drive for continuous winding of the material web onto a winding sleeve. According to the invention, for supporting the winding shaft a carrier unit is provided that is pivotable about a central transverse axis of the device and receives the winding shaft so that it is linearly movable.

28 Claims, 12 Drawing Sheets

DEVICE FOR WINDING WEBS OF MATERIAL

BACKGROUND OF THE INVENTION

The invention relates to a device for winding film webs, paper webs and similar material webs supplied across guide rollers continuously onto a winding shaft.

In known devices for winding material webs, the material webs are supplied to a winding shaft across a counter roller that is supported in a device frame part. The winding shaft is controllable by horizontally movable support modules in accordance with the formed material roll wherein in the transfer area of the material web a fold-free winding is achievable only with high technical expenditure.

SUMMARY OF THE INVENTION

The invention is concerned with the problem of providing a device of the aforementioned kind for winding material webs wherein during all winding phases optimal pressing and transfer conditions are ensured on the winding shaft with minimal technical expenditure, wherein with minimal adjusting expenditure a fast change for continuous supply of subsequent winding shafts can be carried out, and wherein with a minimal space requirement a variable and disruption-free control of the winding shaft is possible during roll transfer.

The invention solves this problem with a device for winding material webs in that as a support for the winding shaft a carrier unit is provided that is pivotable about a central transverse axis of the device and receives the winding shaft so that it is linearly movable.

The device according to the invention has at its device frame parts two support beams that are embodied as pivot arms and are provided as a functional unit integrated into the machine control unit for manipulating the winding shaft for supply and removal in the winding area as well as for movement control when generating a complete material roll. On the two pivot arms, the winding shaft is supported by means of a radially movable holding device, and, at the same time, the pivot arms themselves are pivotable about a central longitudinal axis of the counter roller that forms a central axis of the device so that in this way for the supplied winding shaft different operational positions can be achieved and for the material roll that is currently in the winding phase optimal receiving conditions for the material web can be generated based on two active movements that can be overlapped.

In this connection, for the control of the pivot and linear movements of the winding shaft a computing unit is provided that cooperates with the drive members in the area of the pivot arms, wherein determined material characteristic values of the material web and data for a momentary diameter of the material roll are processed by means of the computing unit and the weight of the material roll is calculated. Based on these data, an optimal contact pressure in the transfer area of the material web can be generated in accordance with the increase in radial spacing of the material roll relative to the counter roller during winding. In this way, an easily and continuously executable angle adjustment of the pivot arms can be utilized and, based on the radial spacing relative to the counter roller, respectively, a force component in the direction of the counter roller can be generated that can be derived from the polar coordinates of the material roll so that the winding process can be controlled optimally during the entire winding period.

The winding shaft that is engaged by the holding device is moved during winding by means of a linear drive radially away from the counter roller; for the angle adjustment, the pivot arms are expediently connected by means of a ring gear and a drive pinion engaging it with an actuating drive. The pivot arms in the device have a pivot range of more than 140°, but can also be moved continuously in partial ranges of less than 1° so that, particularly in the proximal area of a longitudinal machine plane extending horizontally through the pivot axis, a continuous fine adjustment of the pivot arms is possible.

The holding device for the winding shaft has receiving depressions for receiving the winding shaft in a releasable way in which the winding shaft is secured upon upward pivot movement of the pivot arms into a holding position above the operating area of the device. After reaching this position, the winding shaft can be received by support parts and can be secured in a parking position. A changing and initial winding device that is also connected to the control unit of the device cooperates with the support parts; the changing and initial winding device receives the winding shaft, respectively, from the holding position and moves it to the counter roller for winding a new starting end of the material web. After initial winding, the pivot arms of the support beam again receive the winding shaft, onto which in the meantime a partial material roll has been wound, in the holding device that, for producing a complete material roll, can be moved linearly on the pivot arms.

For performing the winding process that is to be carried out without a standstill time, the pivot arms are pivoted into a substantially horizontal working position in which the afore described control process that utilizes the slanted position of the pivot arms is triggered by means of the operating parts of the device integrated into the computer. The winding process is monitored by means of corresponding sensor data so that even for high winding speeds of, for example, more than 100 m/min. a disruption-free winding process is ensured.

The complete material roll that has been wound to its maximum receiving state can be received, after cutting the material web, with minimum expenditure by a lifting carriage that can be moved into a position underneath the pivot arms, wherein, by means of the pivot arms that are moved into an operating position near the ground, an excellent accessibility in the area of the device is achieved.

During this removal of the complete material roll and the subsequent insertion of the next winding shaft that follows in the continuous winding process into the holding device, in the area of the counter roller the second winding shaft supplied from the holding position is already integrated into the winding process after the separating cut of the material web wherein a winding drive of a reduced drive power is effective. The pivot arms that are simultaneously provided anew with the next winding shaft move this winding shaft into the holding position and, subsequently, the receiving parts of the holding device are moved to the winding shaft that is in the initial winding phase.

In this operating phase of the device, a main drive provided as a central drive is switched on in the area of the winding shaft that is already being driven in the initial winding operation by means of an auxiliary drive, and the winding shaft is received by the pivot arms or the holding device. The winding drive that up to this point has acted as an auxiliary drive can now be reduced with regard to its power and, at the same time, the greater drive torque of the central drive switched on as the main drive becomes effective. In this way, a continuous winding process is achieved over all and is commenced with the already described angle and radial control in the transfer area to the material roll until the complete material roll has been generated.

BRIEF DESCRIPTION OF THE DRAWINGS

With regard to further details and advantages of the invention reference is being had to the following description and the drawing in which the device according to the invention will be explained in more detail with the aid of one embodiment. In the drawing it is shown in.

DESCRIPTION OF PREFERRED EMBODIMENTS

Figure 1:
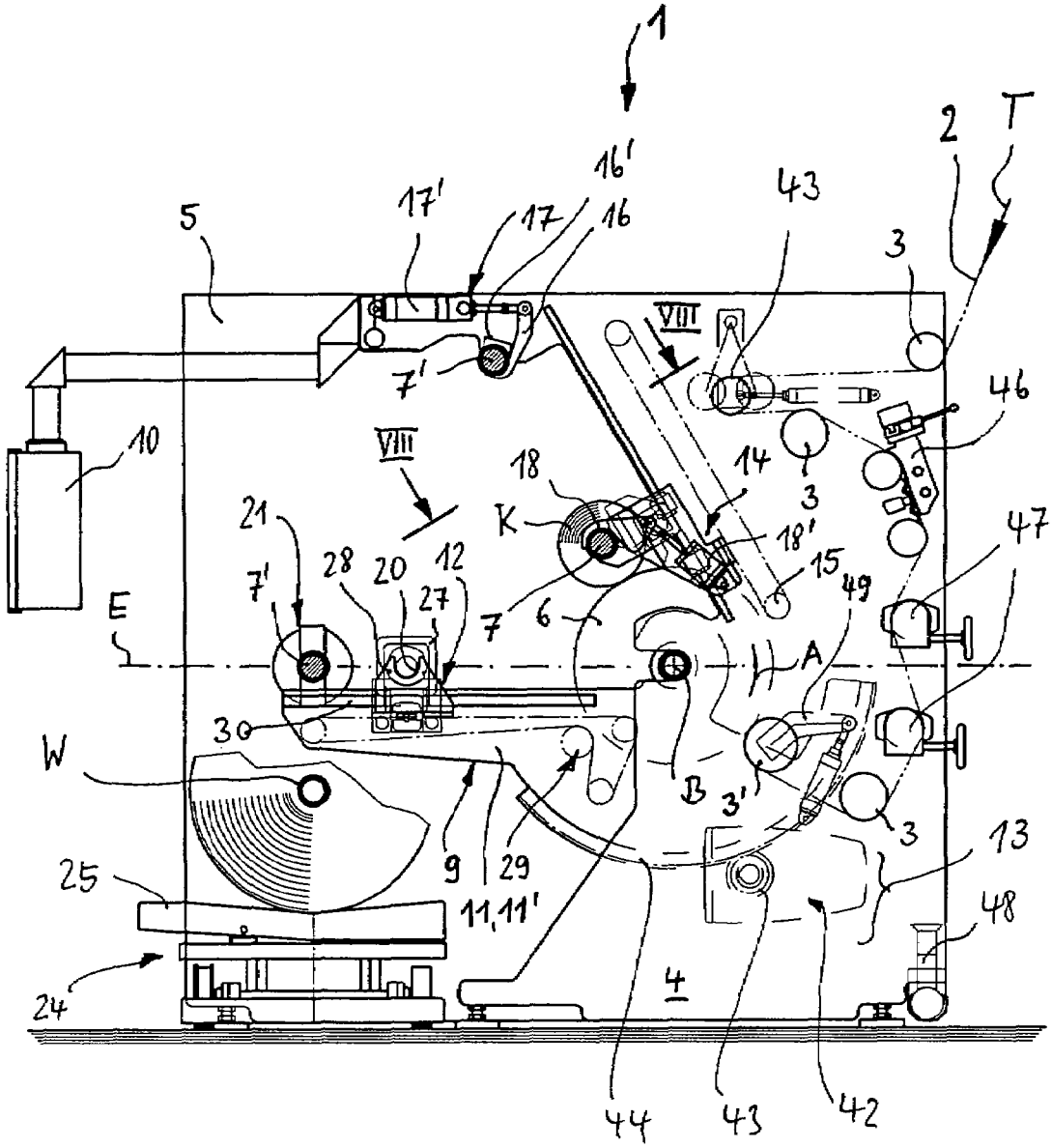
FIG. 1 a side view of a device for winding material webs provided with several winding shafts.

FIG. 1 shows a device indicated in its entirety by 1 for winding a material web 2 that is indicated by a dash-dotted line, wherein particularly a continuously conveyed film web or paper web is considered that reaches the device 1 in a supply direction (arrow T). The material web 2 is guided by means of guide and contact rollers 3, 3', not shown in more detail, into the device 1 having a forward lateral frame 4 and a rearward lateral frame part 5 and guided to a counter roller 6 that is driven in the counterclockwise direction (arrow A) in the illustrated embodiment. A winding shaft 7 cooperates circumferentially with this counter roller 6; the shaft 7 is rotatable (arrow A', FIG. 6) and is supported within the device 1 so as to be movable. The shaft 7 is provided with a winding sleeve W for continuously winding the material web 2 thereon. It is also conceivable that the counter roller 6 is rotated in the clockwise direction.

Figure 2:
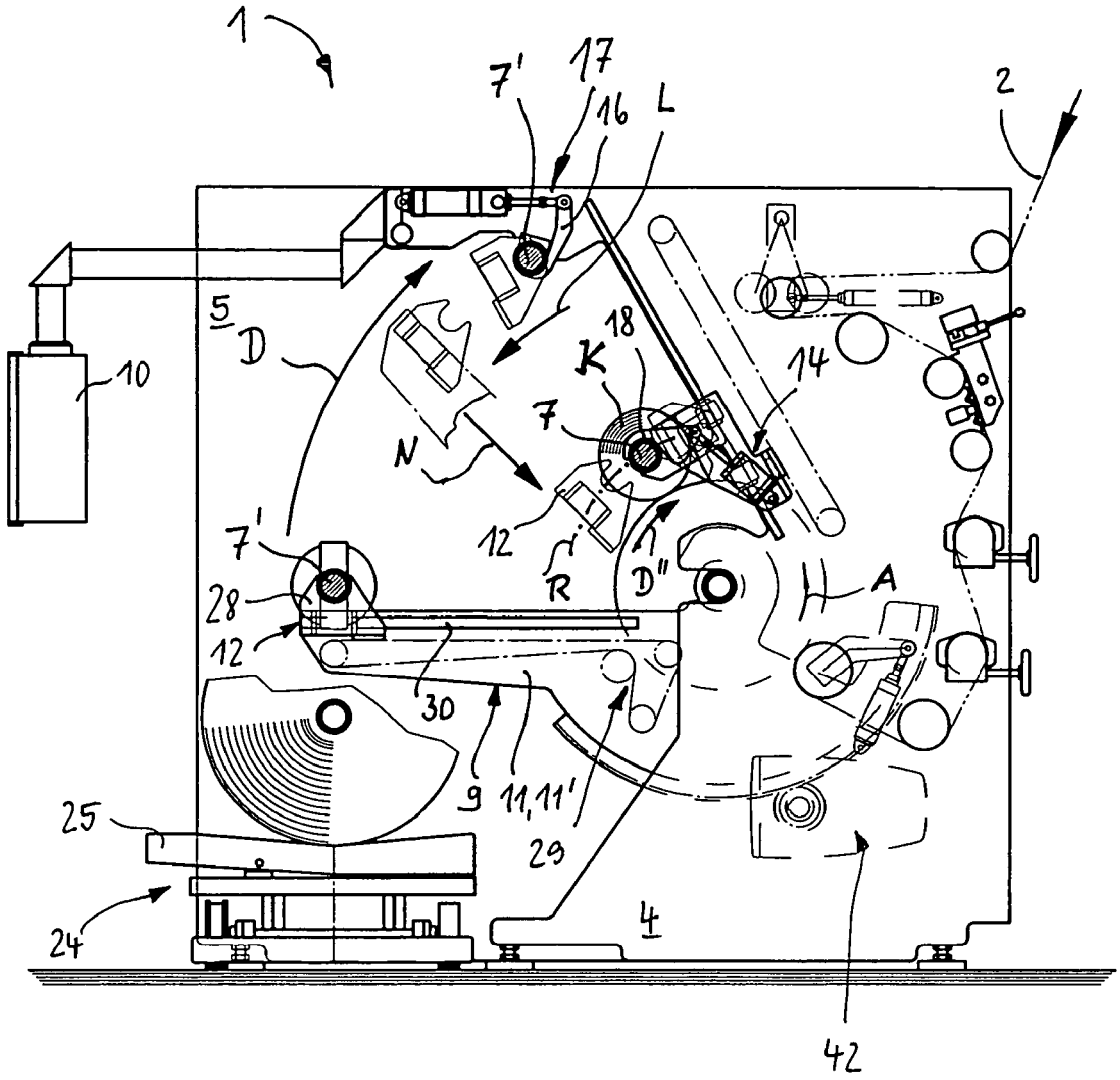
FIG. 2 a side view similar to FIG. 1 upon movement of one of the winding shafts into an upper parking position.
Figure 3:
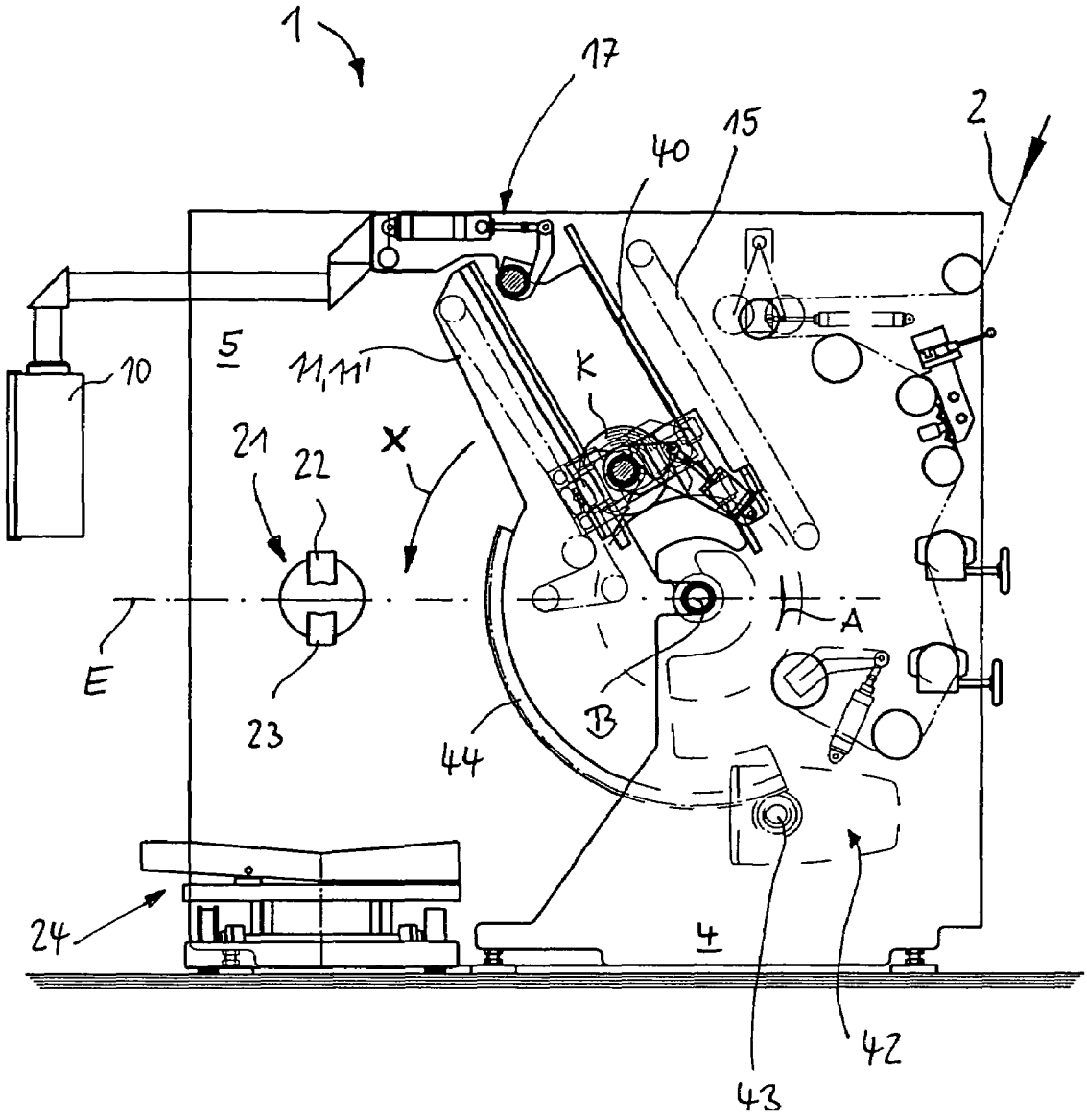
FIG. 3 a side view similar to FIG. 1 where one of the winding shafts is received from an initial winding device.
Figure 4:
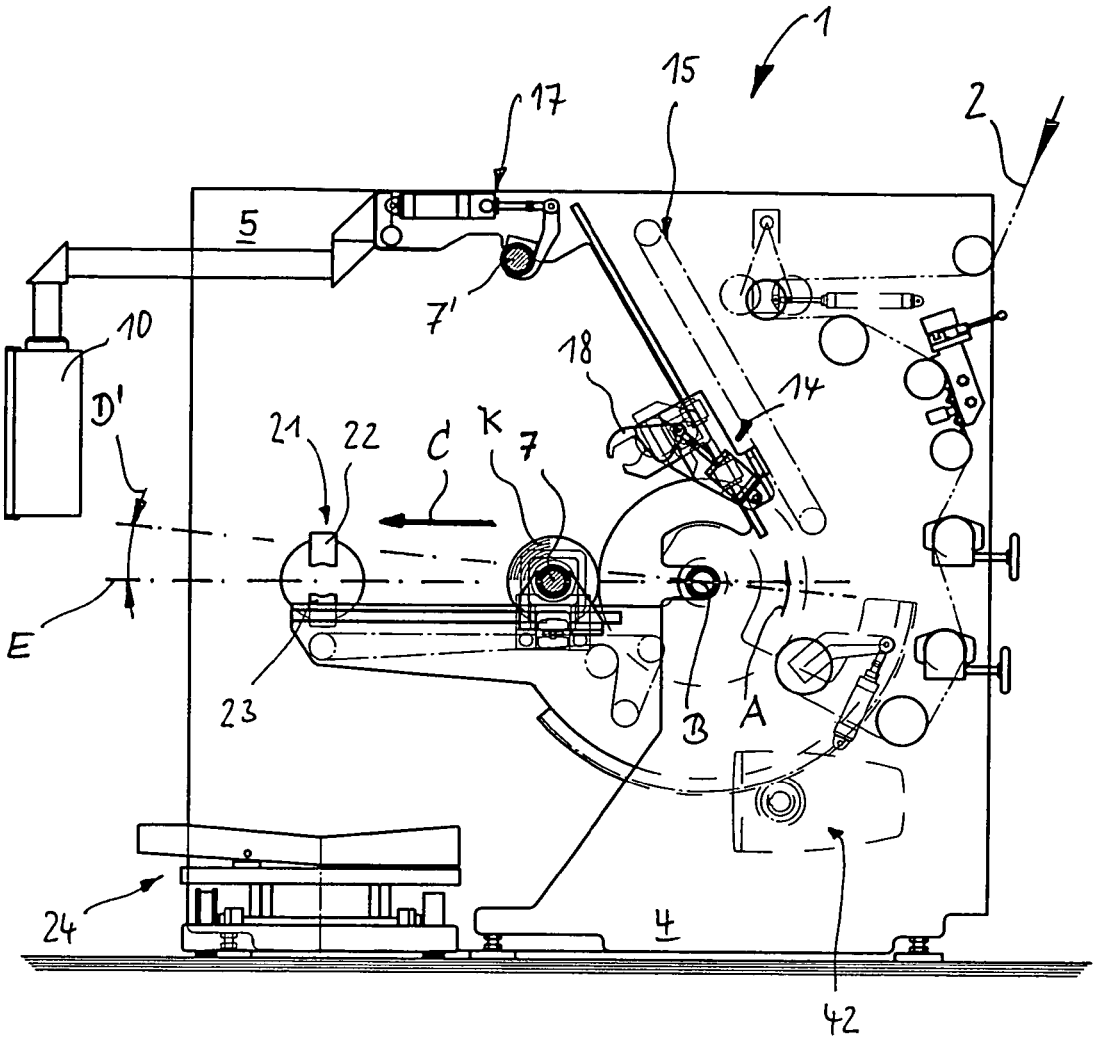
FIG. 4 a side view similar to FIG. 3 with a module that has been moved into a winding position for producing a complete material roll.

The device 1 has in the embodiment according to the invention a support for the winding shaft 7 that is formed by a carrier unit 9 that is pivotable about a central transverse axis B of the device 1 (pivot movement according to arrow D, FIG. 2) and that receives the winding shaft 7 so that it is linearly moveable (arrow C, FIG. 4). The carrier unit 9 in the embodiment illustrated in FIGS. 1 through 7 is supported in the area of the frame parts 4 and 5 such that the linear movement of the winding shaft 7 (FIG. 4) on the carrier unit 9 and its pivot angle, defined as a pivot spacing (arrow D') relative to a horizontal plane E of the device 1, are commonly controllable, at least during winding of the material web 2 to a complete material roll (FIG. 5), together with the linear movement C. For performing the pivot movements and the linear displacement of the winding shaft 7, the device 1 is provided with an electronic control unit 10 that has an integrated computer and enables an automated monitoring of the winding process.

In the illustrated embodiment, the central longitudinal axis of the counter roller 6 forms the central transverse axis B and the winding shaft 7 is supported on the carrier unit 9 so as to be adjustable with regard to its radial spacing relative to the counter roller 6 in the form of a contact roller.

For receiving the winding shaft 7, the carrier unit 9 has two pivots arms 11, 11' (not visible in the side view) that are at least partially integrated into the device 1 and pivotable about the stationary axis B of the counter roller 6 supported within the opposed device frame parts 4 and 5. At least one holding device 12 (FIG. 1) that can linearly support the winding shaft 7 is guided on these pivot arms 11, 11' wherein expediently on each one of the pivot arms 11, 11' one of the holding devices 12 is provided.

In the following, the modules that are arranged essentially mirror-symmetrically relative to the longitudinal center axis M (FIG. 8) of the device 1 on the two pivot arms 11, 11' or the frame parts 4, 5 will not always be expressly mentioned, and for simplifying the description reference will be had to only one of the two pivot arms 11, 11', as visible in the side views and enabling a satisfactory functional explanation.

Figure 5:
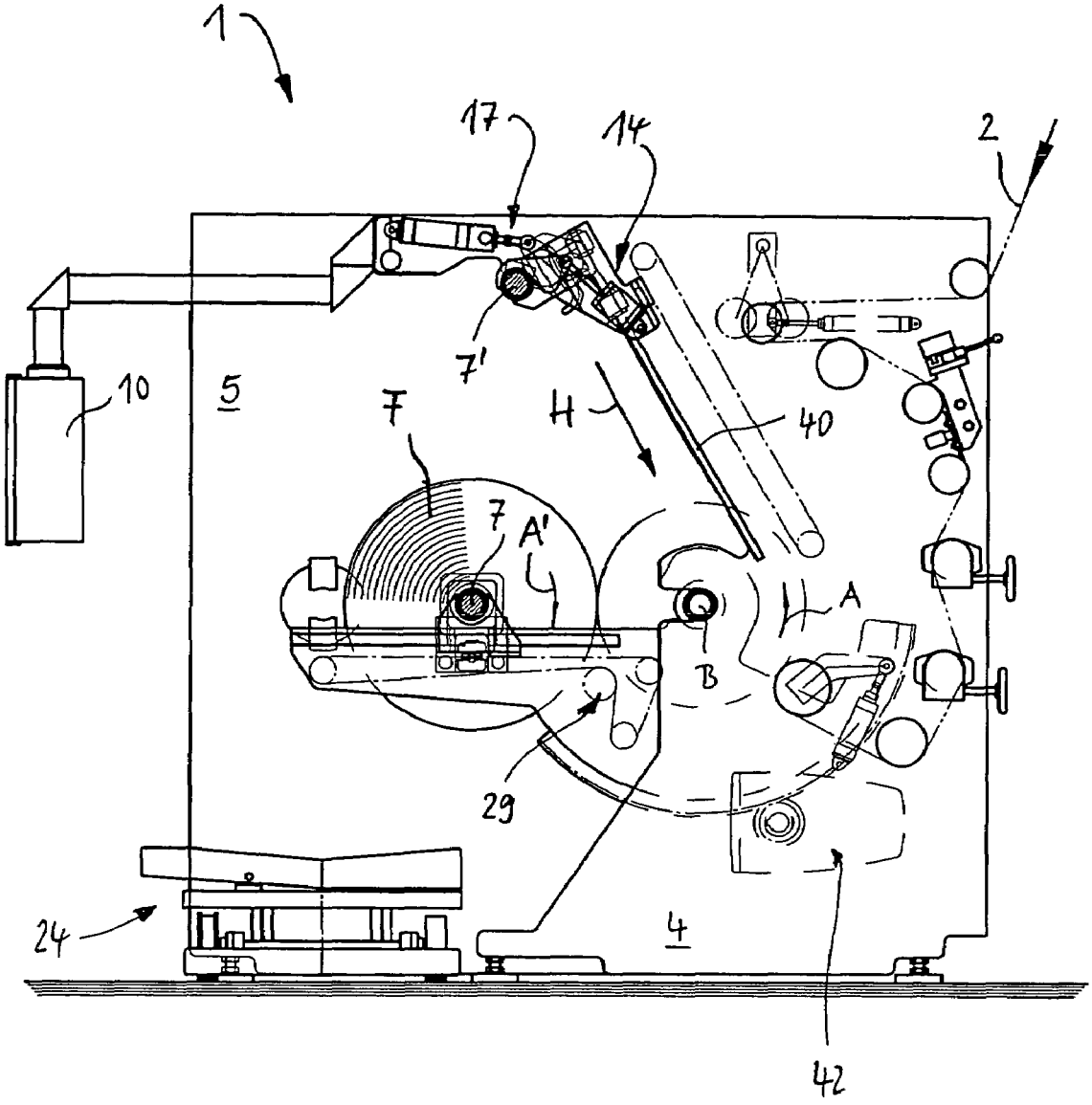
FIG. 5 a side view similar to FIG. 4 with the complete material roll after cutting the material web.
Figure 6:
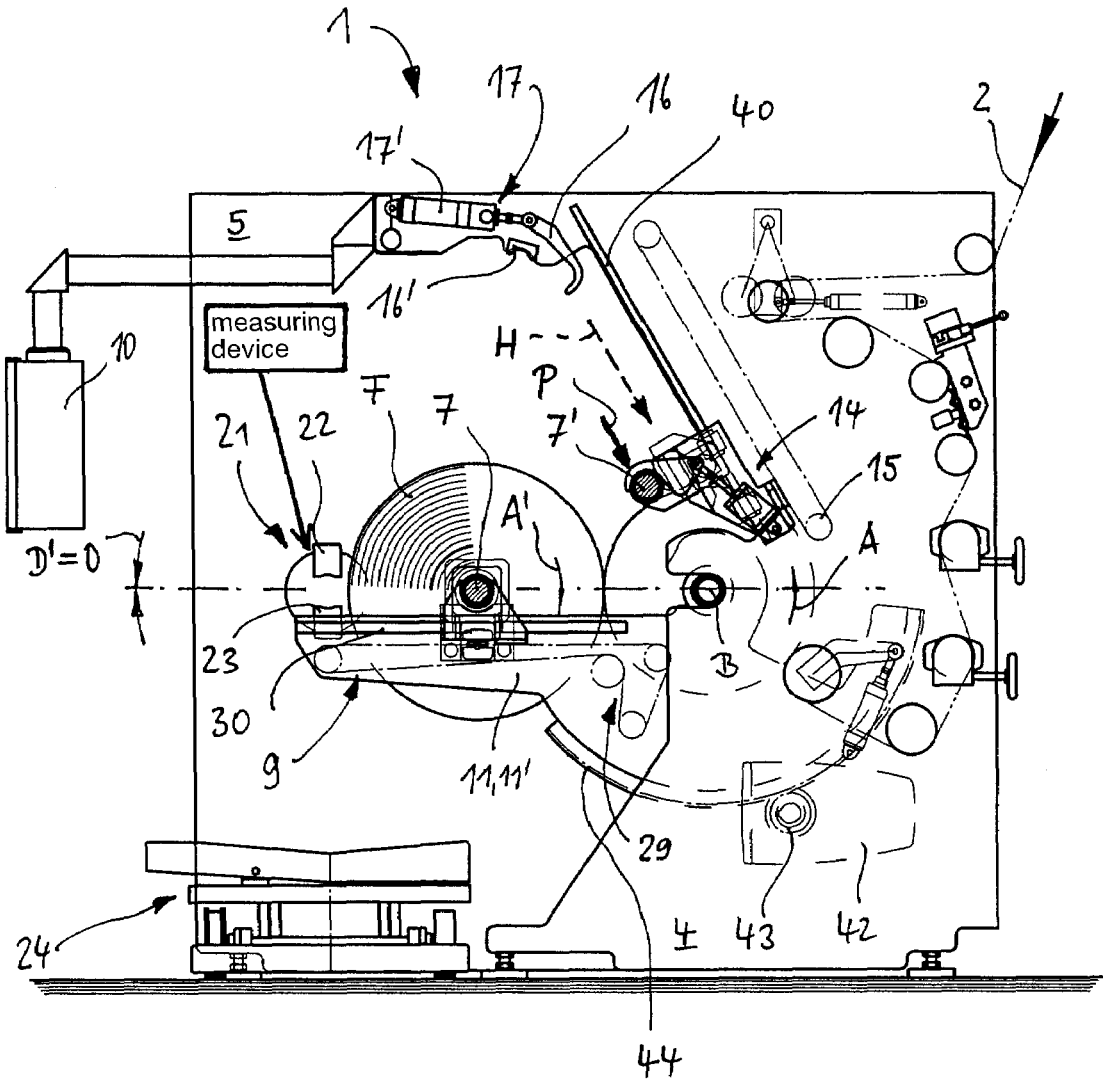
FIG. 6 a side view similar to FIG. 5 with the complete material roll and the subsequent winding shaft that has been moved into the initial winding position.
Figure 7:
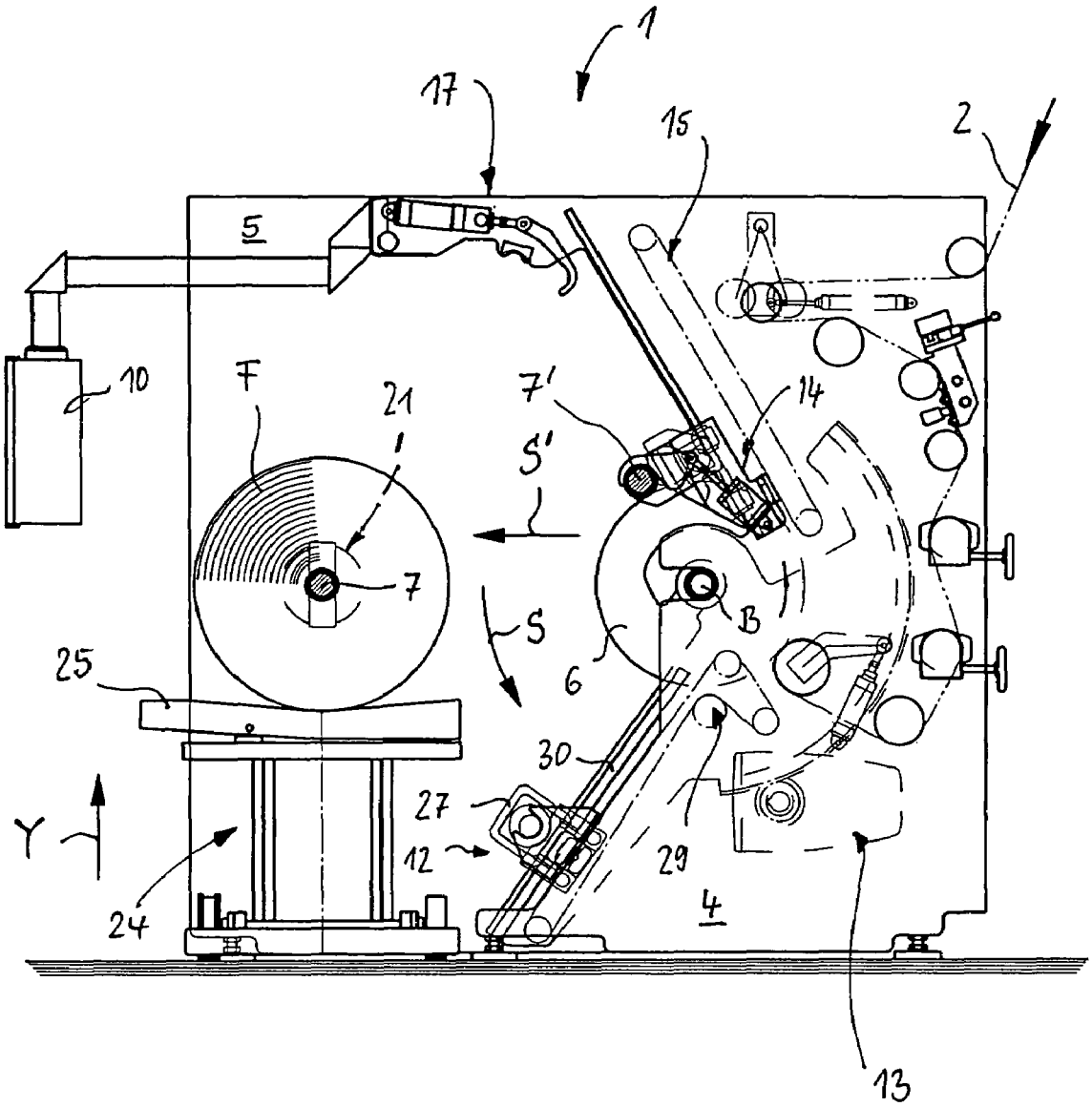
FIG. 7 a side view similar to FIG. 6 with a transport device in the form of a lifting carriage receiving the complete material roll.

When considering the different pivot positions of the pivots arms 11, 11' according to FIG. 7 and FIG. 3, it is apparent that they can be moved from an operating position (FIG. 7) near the ground by means of a pivot drive 13 upwardly (FIG. 2, FIG. 3) and that the winding shaft 7 that can be released from the holding device 12 can be moved into the area of an initial winding device 14 that receives the shaft 7 above the counter roller 6 (FIG. 5). The initial winding device 14 itself is movable together with the received winding shaft 7 by means of an advancing drive 15 radially to the counter roller 6 (FIG. 6).

In place of this operating cycle with the upper pivot position, it is also conceivable that the winding shaft 7, received in the area of the pivot arms 11, 11' by the holding device 12, can be moved directly in the direction toward the initial winding device 14 and is received by it such that in the proximal area of the counter roller 6 an initial winding process can be initiated for the material web 2.

In the functional course of the device 1 illustrated in FIGS. 2 through 6 for a continuous winding process, the winding shaft 7' is moved by means of the pivot arms 11, 11' into an upper holding position (pivot position according to arrow D), is then removed from the holding device 12 by a support device 17 having at least one carrier part in the form of a holder 16 with counter profile part 16', and is secured therein by means of a drive cylinder 17'. From this support device 17 the winding shaft 7 can be removed according to the control program by the initial winding device 14 and can be moved by it radially toward the counter roller 6 (arrow H, FIG. 5, FIG. 6).

The winding shaft 7 can be removed from the initial winding device 14 (FIG. 2, thin line illustration) at a later point in time by means of the holding device 12 guided also on the pivot arms 11, 11' toward the counter roller 6. For this purpose, an intermediately formed partial material roll K (FIG. 2, FIG. 3) is transferred to the pivot arms 11, 11', and they can be pivoted back over all (arrow X, FIG. 3). into a substantially horizontal winding position (FIG. 4).

For continuously performing the winding process, the simultaneous use of two winding shafts 7, 7' is required wherein the initially inserted winding shaft is identified by 7 and the subsequently inserted shaft is identified by the character 7'.

Starting in the functional phase according to FIG. 2, the winding shaft 7 for forming the partial material roll K is already in the initial winding device 14 and the subsequent winding shaft 7' is pivoted upwardly according to the thinner dashed line illustration in the direction of the arrow D and is secured in the support device 17 in the holding position. Subsequently, the pivot arms 11, 11' can be pivoted back from the transfer position (arrow L) and the holding device 12 can be moved in the direction of arrow N linearly toward the counter roller 6.

In this way, the holding device 12 reaches the proximal area of the initial winding device 14 where the first winding shaft 7 provided with the partial material roll K is rotating in the operating position.

For taking over this winding shaft 7, the holding device 12 is positioned on the pivot arms 11, 11' such that a holding part 18 of the initial winding device 14 that is provided with a drive 18' for the winding shaft 7 has a transfer position that is located on a common radius R with the holding device 12 (FIG. 2), and, by means of a short pivot movement of the pivot arms 11, 11' in the direction of arrow D", a transfer of the winding shaft 7 (FIG. 3) into the holding device 12 takes place. Subsequently, the pivot arms 11, 11' can be moved in a pivot direction X to the horizontal plane E (FIG. 3) wherein simultaneously by means of the control unit an optimal angle position for the winding process is determined (FIG. 4). The winding shaft 7 rotating in the direction of arrow A' is received in a receiving depression 20 of a support leg 28 of the holding device 12, and the latter is displaced with increasing diameter of the complete material roll F by means of a linear advancing member 29 (arrow C). In this connection, a guide 30 provided on the pivot arm 11 is effective.

The initial winding device 14 has an auxiliary drive 26 (FIG. 8) by means of which a new starting end of the material web 2 formed after a separating cut is engaged by the winding shaft 7, and in the area of the pivot arms 11, 11' a central drive 27 is arranged that is provided as a winding drive and is designed for rotating the roll of great weight that is growing to a complete material roll. By means of the system control, the drive power of the central drive 27 and of the auxiliary drive 26 in the area of the initial winding device 14 can be controlled at the same time, wherein this control is necessary in particular in the afore described transfer moment of the winding shaft 7 from the initial winding device 14 into the holding device 12 explained supra in connection with FIG. 2 and FIG. 3. In an expedient embodiment, the control is such that, when switching on the central drive 27, the auxiliary drive 26 is synchronously switched off with increasing drive torque of the central drive.

In FIG. 5, a complete material web roll F is illustrated on the winding shaft 7 and for the subsequently scheduled changing process the initial winding device 14 is already moved to the support device 17 positioned at the top in order to remove the next winding shaft 7' from the holding position. This removing step is terminated in the control phase illustrated in FIG. 6, and the initial winding device 14 is moved linearly (arrow H) by means of its advancing drive 15 from the upper transfer position, where the winding shaft 7' is engaged by means of the holding parts 18, toward the counter roller 6 into the initial winding position. Now it is possible to perform the separating cut (not illustrated in detail) for the material web 2 in the area of the counter roller 6 for which purpose a cutting device (not illustrated in detail) of a known design arranged in the counter roller is activated. The end of the material web 2 that is leading with regard to the winding process continues to move in accordance with the rotational direction A' in the winding direction and the new end of the material web 2 that is leading in the rotational direction A is engaged by the winding shaft 7' that is pressed in the pressing direction P (FIG. 6) against the counter roller 6 so that winding of the partial material roll K begins and the material web 2 over all can be further processed without any loss of material.

While in the area of the winding shaft 7' the afore described winding process continues, the removal of the complete material roll F out of the device 1 is prepared by means of the control of the device 1. For this purpose, the pivot arms 11, 11' in the horizontal movement range of the holding device 12 are connected to a pulling device 21 (FIG. 1) provided for the transfer of the complete material roll F.

The pulling device 21 is supported in the area of the rear frame part 5 and can engage the winding shaft 7 with the complete material roll F (FIG. 7) that is moved into its area in accordance with the linear advancing movement C. The winding shaft 7 after its movement in the direction of arrow S' is engaged and secured by means of radially movable clamping holders 22, 23 (FIG. 6), respectively, so that subsequently the pivot arm 11 can be moved (arrow S) into the lowered position near the ground, illustrated in FIG. 7. However, this lowering process according to S is carried out only after a lifting device in the form of the lifting carriage 24 that is inserted into the area of the device 1 up to the complete wound roll has been moved in the direction of arrow Y in such a way underneath the complete material roll F that its weight rests on a support plate 25 of a lifting carriage 24. In this way, a relief process for the winding roll 7 is realized that is detected by means of a measuring device (not illustrated) in the proximal area of the pulling device 21 in the frame part 5. After its release signal, the pivot arms 11, 11' are pivoted into the illustrated position of FIG. 7 so that the operating area arranged in front of the frame part 4 is released. The weight of the complete material roll F rests completely on the lower carriage 24 and it can be moved perpendicularly to the plane of illustration out of the device 1. Subsequently, a new sleeve W is pushed onto the winding shaft 7' that is still secured on the pulling device 21 and the continuous winding process is continued, beginning with FIG. 2.

The winding shafts 7, 7' are configured with regard to their length preferably to a working width of 1,600 mm wherein, however, it is also provided that material webs 2 having a working width of up to 4,000 mm are to be wound. Therefore, in the area of the pulling device 21 additionally a support module is provided for such devices (not illustrated) cooperating by means of the control with the pulling device wherein the support module during or after movement of the complete material roll F out of the device 1 engages from below the freed winding shaft 7 such that it is secured safely even when having a great length. It is also conceivable that the support module is secured on a transverse beam above the working space and can be pivoted into the support position.

The described device 1 forms over all a compact winding machine which with a minimal spatial requirement and comparatively few operating elements enable winding of materials and roll sizes of very different kinds. The employed control unit 10 is particularly efficient in that by means of the angularly adjustable pivot arms 11, 11' a control program that replaces the known X-Y coordinate system and is based on polar coordinates can be employed. In this connection, based on the spacing of the winding shaft 7 in the direction of arrow C and the slanted position of the winding shaft according to the direction of arrow D the corresponding control signals can be computed. Based on this basic concept, the described and illustrated construction modules represent conceivable embodiments that can be configured to be variable.

Figure 8:
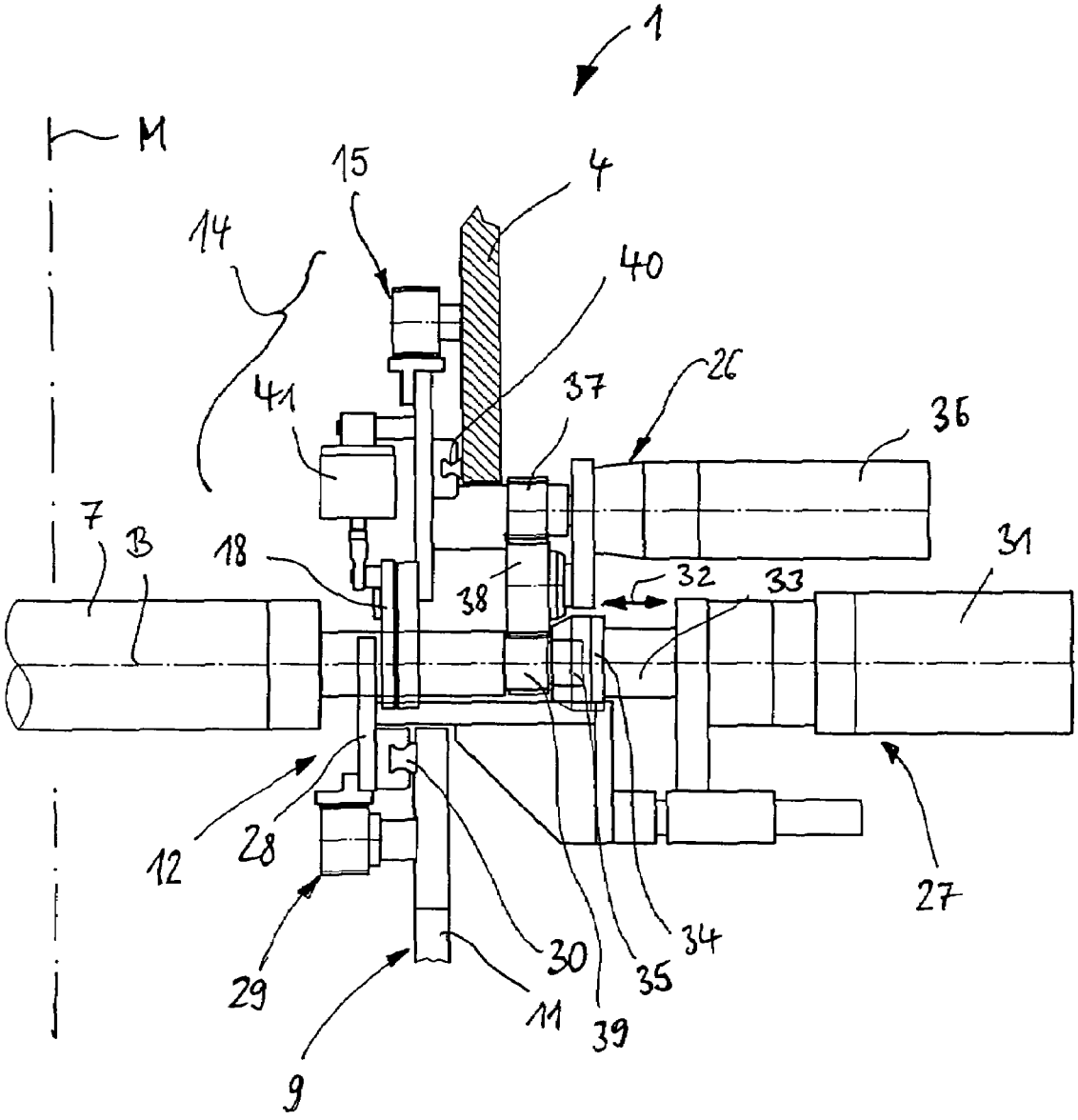
FIG. 8 an enlarged detail view according to a line VIII-VIII of FIG. 1 in a lateral area of the winding shaft with the winding drives.

In FIG. 8, the central drive 27 is illustrated in its connecting position with the winding shaft 7; it is apparent that a drive shaft 33 is provided on a drive motor 31 and is movable axially in the direction of arrow 32. This drive shaft 33, in turn, has at its end face a driver 34 that forms an axially detachable connection by means of a toothing 35 of the winding shaft 7.

The initial winding device 14, also illustrated in detail in FIG. 8, has in the area of the auxiliary drive 26 the drive motor 36 that engages by means of a pinion 37 and a turning wheel 38 an outer toothing 39 on the winding shaft 7. In place of such a gear connection a drive by means of a toothed belt, a friction wheel or similar components is also conceivable. The initial winding device 14 in the area of its advancing device 15 is connected by a guide 40 to the frame part 4, and the holding part 18 can be actuated by means of a pressure cylinder 41.

For driving the pivot arms 11, 11', a drive member 42 is provided (FIG. 1) that forms a pivot drive 13 and engages by means of a drive pinion 43 a toothing 44 that is arranged in an arc-shape on the underside of the pivot arms 11, 11'. This concept of a pivot drive 13 is constructively simple; it can also be replaced by other drive modules.

Further modules in the area of the supply of the material web 2 are integrated into the entire system of the device 1 wherein 45 indicates a dancing module for controlling the material tension, 46 indicates a length cutting device, and 47 indicates the components of a stretching device. A vacuum pipe is indicated at 48 for the edge strips separated from the material web, and 49 indicates in an exemplary fashion a pneumatically actuated contact roller.

In the described device 1, the material web 2 can be transferred to the material roll F in the area of the driven counter roller 6 by a contact winding process. Also, it is conceivable that a gap winding process is realized wherein between the material roll F and the counter roller 6 a transfer gap is present and for driving the material roll F only the central drive 27 is used. Moreover, it is possible with the device 1 to perform the winding process with afore described contact of the rotating roller parts and to integrate at the same time the central drive additionally into the drive concept. In this way, a tighter winding process can be controlled and the winding density on the material roll F can be increased with minimal expenditure in an advantageous way.

Figure 9:
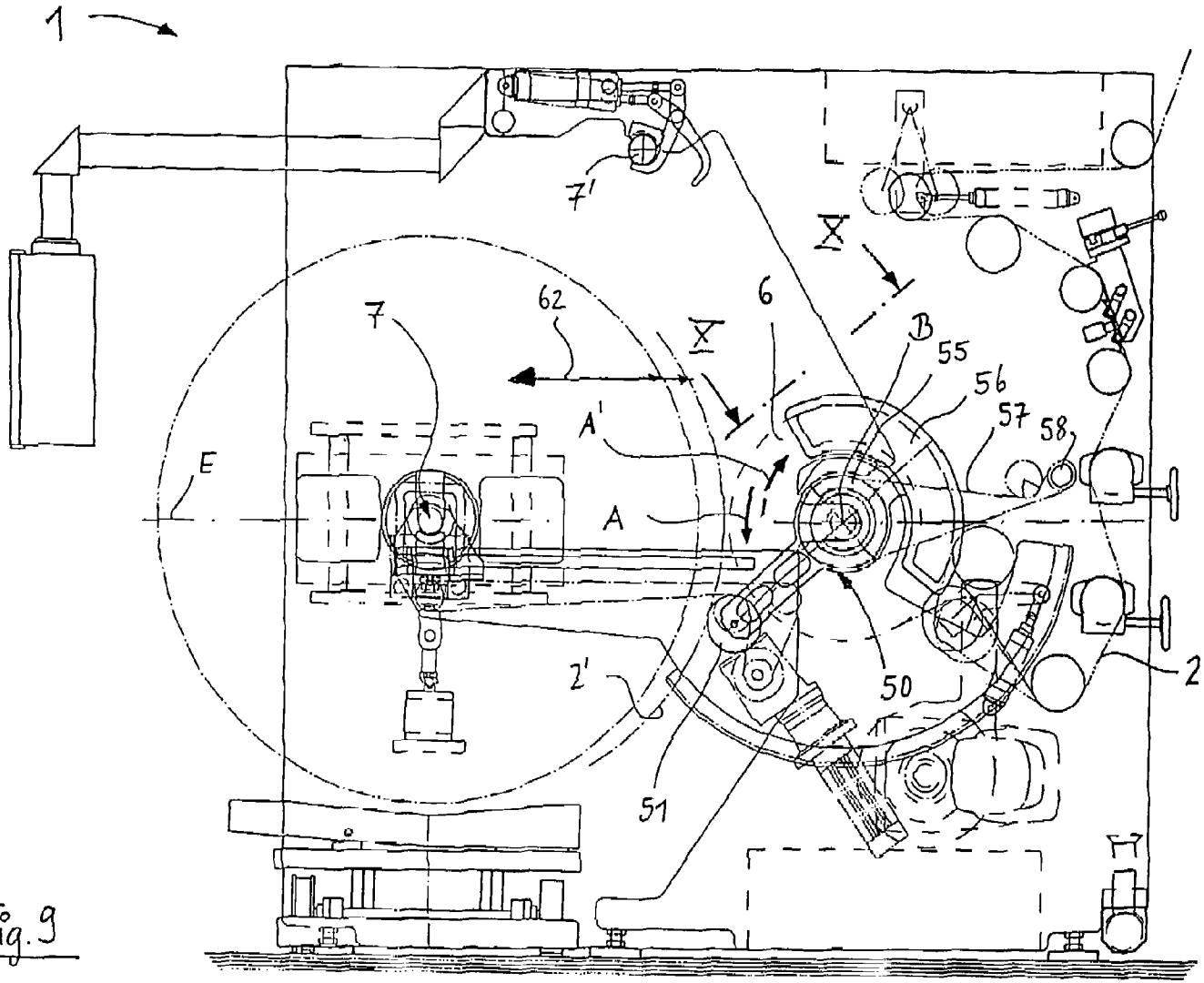
FIG. 9 a side view of the device similar to FIG. 6 provided in the area of the counter roller with a pressing device.

FIG. 9 shows the device 1 (for a better illustration without the module in the area of the initial winding device 14) in a side view similar to FIG. 6 wherein this machine embodiment in the area of the counter roller 6 has a pressing device 50 that moves the material web 2' (FIG. 13) by means of a contact roller 51 in the direction toward the outer circumference of the winding shaft 7. In an expedient embodiment, the pressing device 50 is pivotably supported in the area of the transverse axis B of the device 1 so that the contact roller 51 can contact, independently of the rotational direction of the counter roller 6 (counterclockwise direction: arrow A; clockwise direction: arrow A'), the area of the material web 2' that is located in its winding phase behind a winding gap 52 (FIG. 12) between the counter roller 6 and the winding shaft 7.

The winding gap 52 between the counter roller 6 and the winding shaft 7 or the wound material web 2' is adjustable by means of the component modules described in connection with the embodiment of the device 1 in FIGS. 1 through 8, for example, by means of the linear advancing member 29. It is conceivable in this connection that the dimension of the winding gap 52 is 2 mm to 20 mm, preferably 10 mm, respectively, as a function of the winding properties of the material to be wound.

Figure 10:
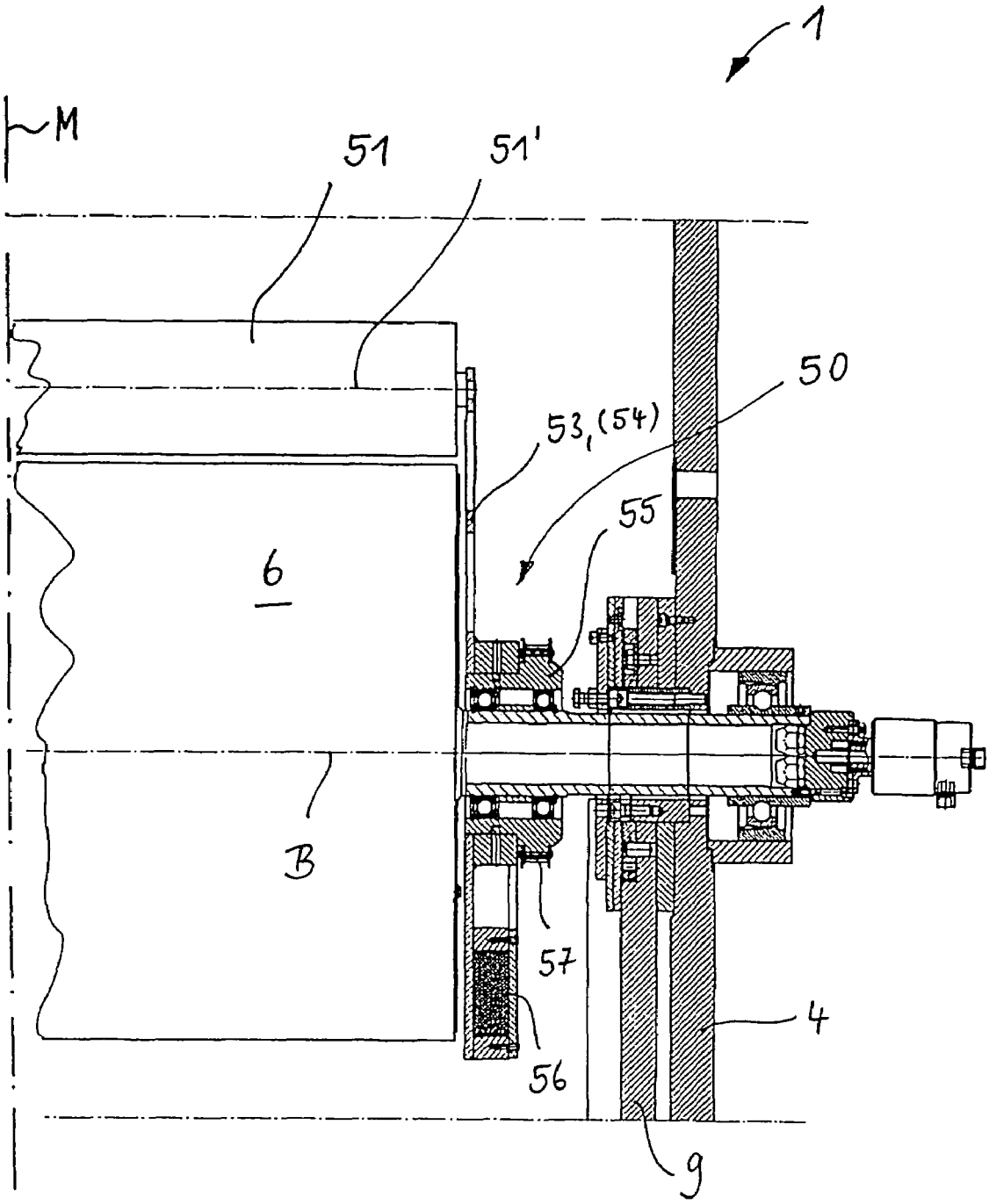
FIG. 10 an enlarged detail view according to line X-X of FIG. 9 in the lateral area of the counter roller.

When looking at FIGS. 9 and 10, it is apparent that the pressing device 50 has support legs 53 (or 54, not illustrated with the opposed components) that are positioned mirror-symmetrically to the longitudinal center plane M of the device and support the contact roller 51 to be rotatable about the transverse axis 51', which support legs are supported in the area of a support ring 55 surrounding the respective transverse axis B, respectively, such that the pressing device 50 is freely pivotable about the counter roller 16. This support ring 55 is connected to a weight part 56 positioned opposed to the contact roller 51 and effective as a weight-compensating component relative to the contact roller 51.

In contrast to the conditions described in connection with FIGS. 1 through 8 for winding the material web 2 by means of the counter roller 6 acting as a contact roller on the winding shaft 7 movable on the carrier unit 9, by means of the additional pressing device 50 a more precise adjustment of the contact pressure (arrow Z, FIG. 11) within the winding gap 52 is possible, and this pressure can be adjusted in small adjusting steps. With the additional mounting of the weight-compensated contact roller 51, the contact pressures can be reduced such that they can be set even below those values which can be achieved by a floating contact roller (not illustrated) of a known configuration.

The pressing device 50 illustrated with the weight part 56 in FIG. 9 can be advanced against the material web 2' by a motor or pneumatically for which purpose, for example, a toothed belt 57 cooperates with a pivot drive 58. The contact roller 51 compensated with regard to its own weight can be moved particularly sensitively wherein the pressure in the direction of the arrow Z can be less than 200 N up to 30 N. Corresponding to the drive concept pressure adjustments of less than 30 N are conceivable also so that for different film material an optimal combination of web tension and pressure Z is adjustable and, in this way, a reliably and disruption-free winding process is ensured.

Figure 11:
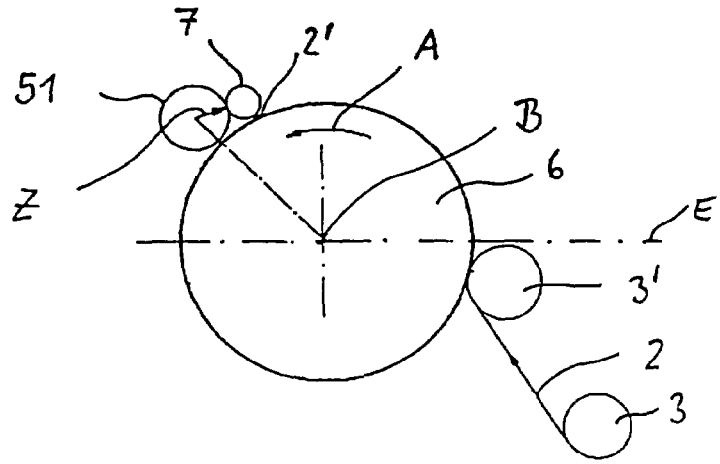
FIGS. 11 to 13 a basic illustration, respectively, of the pressing device in different winding phases with the counter roller rotating in a counterclockwise direction, respectively, and FIGS. 14 to 16 a basic illustration, respectively, with the pressing device wherein the counter roller rotates in the clockwise direction, respectively.

In FIG. 11, the principal engagement conditions in the area of the winding gap 52 with the counter roller 6 are illustrated wherein the roller 6 rotates in a counterclockwise direction (arrow A). The material web 2 is guided across guide and contact rollers 3, 3' to the counter roller 6 and is received by the winding shaft 7 in the area of the gap 52, wherein the winding shaft 7 provides from above the contact with the contact roller 51, i.e., the contact roller 51 is pressed from below against the winding shaft 7. As a result of the winding process initiated in the area of the initial winding device 14 (not illustrated in FIG. 11 through 16) the diameter 59 (FIG. 12) of the wound material web continuously grows and, by means of the contact roller 51, a uniform pressure of the material web 2' in the direction of the arrow Z is realized with a continuously adjusted angular spacing 60 relative to the gap plane 61.

Figure 12:
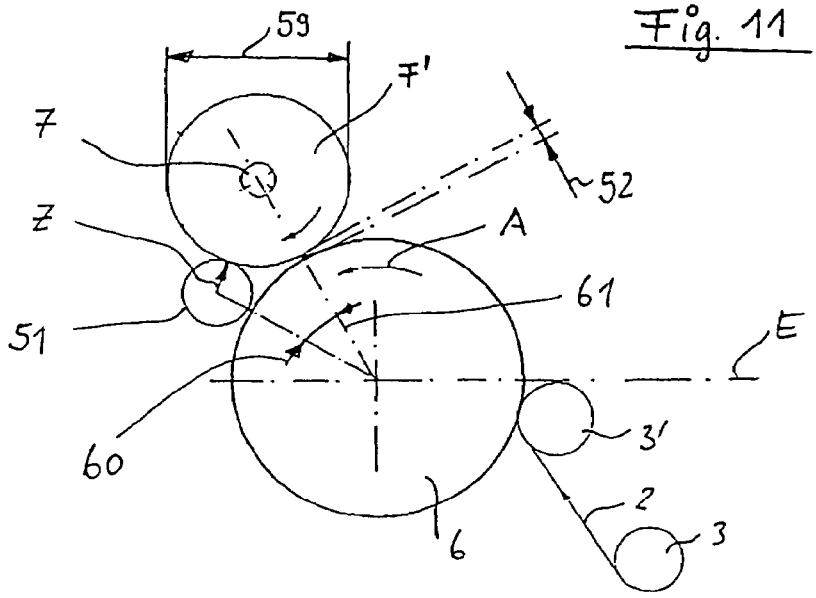
Figure 13:
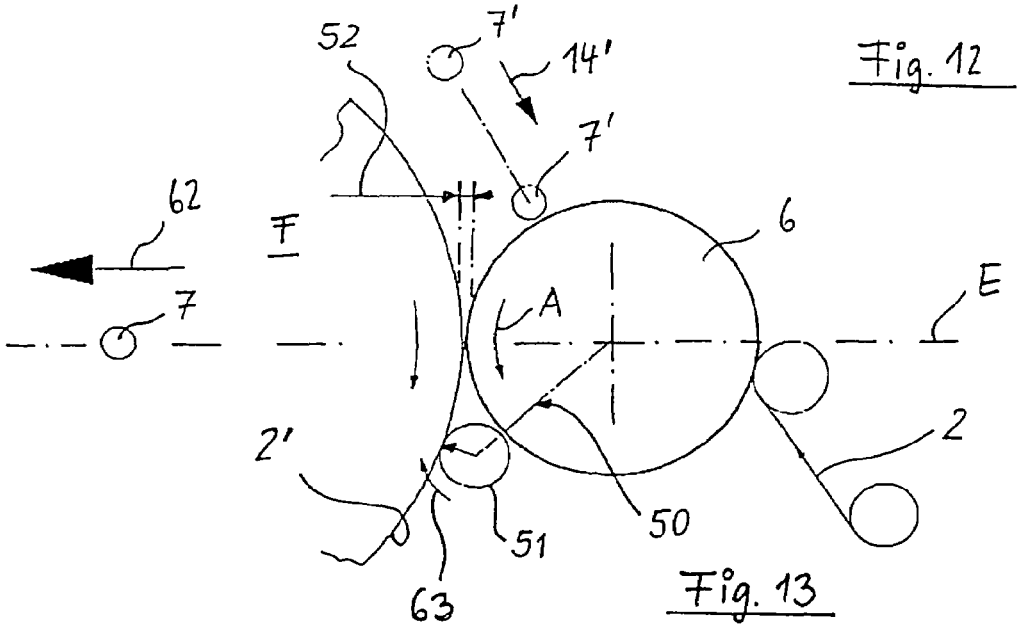

In FIG. 12, a first winding phase by means of the contact roller 51 engaging from below the winding shaft 7 is completed, wherein the obtained weight of the wound roll F' is equivalent to the diameter 59 and, for example, after reaching a diameter 59 of 400 mm, the carrier unit 9 receives the winding shaft 7 above the horizontal plane (similar to this: course according to FIGS. 1 to 5). For a continuously advancing winding process, the complete winding roll F illustrated in FIG. 13 is then generated.

With the continuous enlargement of the diameter 59 up to the complete material roll F, the contact roller 51 can be moved into the position illustrated in FIG. 13 below the horizontal plane E. In this way, the initial winding device 14 (not illustrated in more detail) arranged above the counter roller 6 can become effective. By means of the device 14, the winding shaft 7' is transferred above the horizontal plane E into the illustrated initial winding position (arrow 14' in FIG. 13). At the same time, the complete material roll F is moved in the direction of arrow 62 away from the counter roller 6 and is moved to the carriage 24 with the support plane 25 for removal (FIG. 9). Subsequently, the contacting device 50 or the contacting roller 51 are pivoted back by means of the drive 58 into the direction of arrow 63 so that the initial position illustrated in FIG. 11 is reached after a short pivot time and the winding process with the new winding shaft 7' can be commenced in a continuous fashion.

For this winding process (FIGS. 11 through 13) with counter roller 6 rotating counterclockwise (arrow A), it is also conceivable that the contact roller 51 is contacted from above against the winding shaft 7 (not illustrated). However, this leads to the momentary pressure zone (arrow Z) of the contact roller 51 having a disadvantageously large spacing from the winding gap 52 because of the growing diameter 59 up to the point of finishing a complete material roll F.

Figure 14:
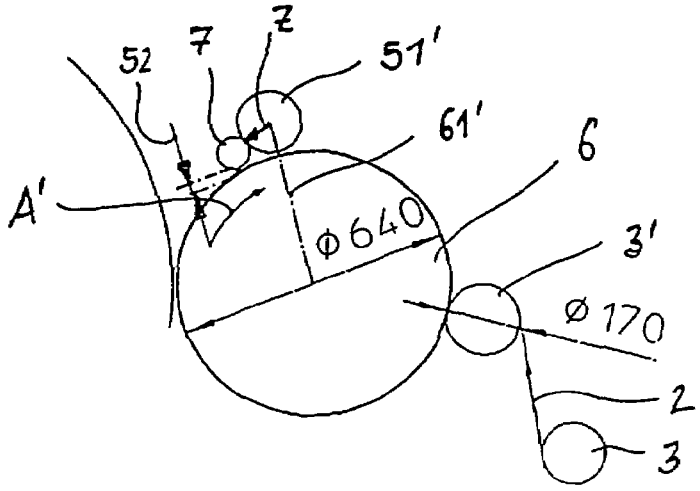
Figure 15:
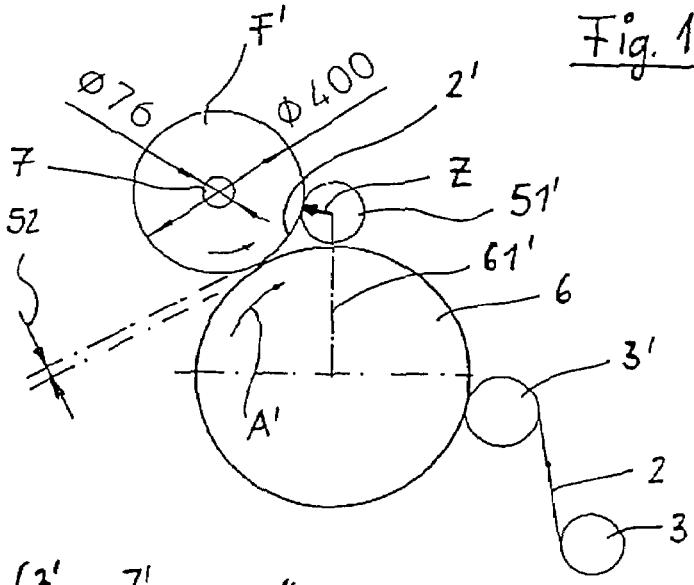
Figure 16:
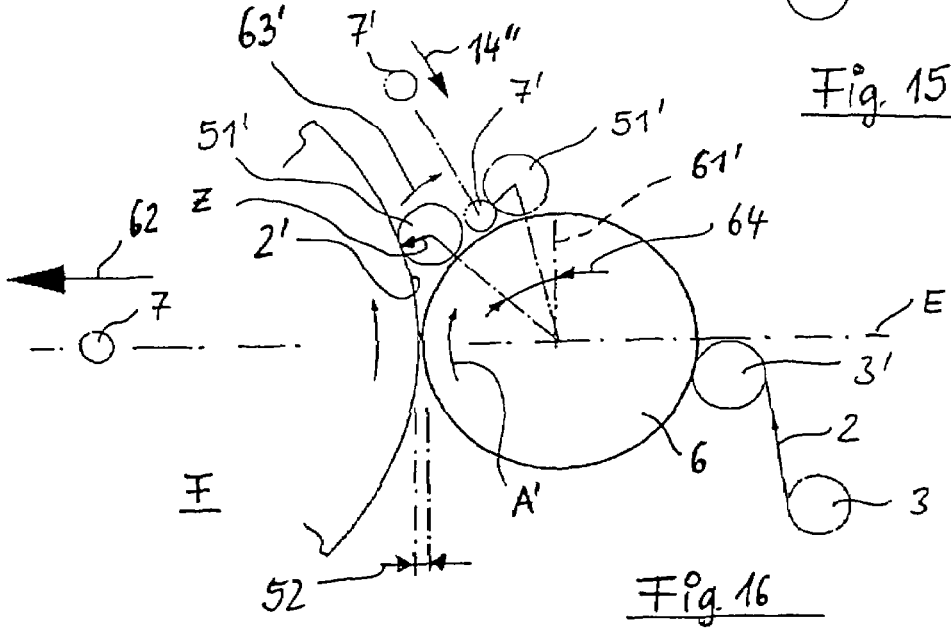

In FIGS. 14 through 16, a second winding situation is illustrated that is comparable to the afore described components; the counter roller 6 has a rotational direction (arrow A') in the clockwise direction. In this configuration the contact roller 51' is placed from above against the winding shaft 7. The wound material of the material web 2 growing to the complete material roll F (FIG. 16) has the effect that the contact roller 51' is moved only by a pivot angle 64 above the horizontal plane E in accordance with the winding phase (FIG. 14: initial winding; FIG. 15: winding in the initial winding device 14; FIG. 16: wound material roll F' received by carrier unit 9). After removal of the complete material roll F (FIG. 16), the contact roller 51' can be returned (arrow 63') into the initial position (FIG. 14) that is defined by the gap plane 61' so that subsequently the next winding shaft 7' can be tangentially advanced in a direction of arrow 14" into a position in front of the contact roller 51' (two-phase illustration in FIG. 16) and the winding process with this winding shaft 7' can be commenced continuously.

In this embodiment according to FIGS. 14 through 16, it is also conceivable that the contact roller 51' is placed against the winding shaft 7 (or 7') from below (not illustrated) and that in this way the appropriate initial winding conditions result.

What is claimed is:

1. A device for winding a web, the device comprising:

device frame parts;

guide rollers arranged in the device frame parts for guiding the web;

a counter roller mounted in the device frame parts for feeding the web;

a rotatable winding shaft;

a carrier unit provided as a support for the winding shaft, wherein the winding shaft is linearly movably mounted on the carrier unit;

wherein the winding shaft cooperates circumferentially with the counter roller;

wherein the winding shaft has a winding drive for continuously winding the web onto a winding sleeve arranged on the winding shaft;

wherein the carrier unit is pivotable about a central transverse axis of the device;

wherein the carrier unit has two pivot arms;

wherein the two pivot arms have at least one holding device that supports the winding shaft so that the winding shaft is linearly movable;

wherein the winding drive is connected to the two pivot arms and comprises at least one central drive drivingly connectable to the winding shaft for driving the winding shaft;

wherein the two pivot arms have at least one linear guide supporting the at least one holding device; and wherein the at least one holding device moves linearly on the two pivot arms as a diameter of wound material grows on the winding sleeve arranged on the winding shaft as the winding shaft is driven by the at least one central drive drivingly connected to the winding shaft.

2. The device according to claim 1, wherein a linear movement of the winding shaft on the carrier unit and a pivot angle of the winding shaft defined as a pivot spacing to a horizontal plane of the device are controllable at least during winding.

3. The device according to claim 2, wherein a central longitudinal axis of the counter roller forms the central transverse axis of the device and wherein the winding shaft is supported on the carrier unit so that a radial spacing of the winding shaft relative to the counter roller is adjustable.

4. The device according to claim 2, further comprising an electronic control unit for adjusting the radial spacing and the pivot spacing of the winding shaft, respectively.

5. The device according to claim 4, wherein the two pivot arms are at least partially integrated into the device and are pivotable about an axis of the counter roller that is stationarily supported in the device frame parts positioned opposite one another.

6. The device according to claim 5, further comprising:

a pivot drive connected to the two pivot arms, wherein the two pivot arms are pivotable upwardly from an operating position near the ground by the pivot drive;

an initial winding device, wherein the winding shaft is detachable from the at least one holding device and is movable into the area of the initial winding device that receives the winding shaft above the counter roller.

7. The device according to claim 6, wherein the initial winding device has an advancing drive and is movable together the winding shaft by the advancing drive radially relative to the counter roller.

8. The device according to claim 7, wherein the at least one holding device and clamping parts provided for the winding shaft on the initial winding device are movable into an upper transfer position that is arranged on a common radius.

9. The device according to claim 8, wherein the initial winding device is linearly movable toward the counter roller by the advancing drive from the upper transfer position, where the winding shaft is engaged by the clamping parts, into an initial winding position.

10. The device according to claim 6, wherein the winding shaft is removable from the initial winding device by the at least one holding device, and wherein the winding shaft, that has been provided with a partial web roll in the initial winding device, is returned by the two pivot arms into a substantially horizontal winding position.

11. The device according to claim 6, further comprising at least one support part, wherein the winding shaft is movable by the two pivot arms into an upper holding position and in the upper holding position is received by the at least one support part from the at least holding device, wherein the initial winding device that is movable radially relative to the counter roller receives the winding shaft from the at least one support part.

12. The device according to claim 11, wherein the two pivot arms are pivoted back from the upper holding position and wherein the at least one holding device is moved linearly toward the counter roller.

13. The device according to claim 11, wherein the two pivot arms are pivotable in the area of the at least one upper support part away from a second one of the winding shafts, wherein the at least one holding device released in this way is movable linearly toward the counter roller, and wherein in the area of the initial winding device the winding shaft that has been provided with the partial web roll is received by the at least one holding device.

14. The device according to claim 6, wherein the initial winding device is provided with an auxiliary drive and driving elements connected to the winding shaft, wherein, by a rotary movement imparted by the driving elements on the winding shaft and by a pressing movement, a second starting end of the web generated by a transverse extending separating cut performed on the web is engaged by the winding shaft.

15. The device according to claim 14, wherein the driving elements are gear wheels.

16. The device according to claim 14, wherein the winding shaft has a radial toothing and wherein the driving elements of the initial winding device engage the radial toothing.

17. The device according to claim 5, further comprising a pulling device, wherein the winding shaft in a horizontal movement area of the at least one holding device can be moved into the area of the pulling device for transfer of a complete web roll, wherein the pulling device is cantilevered on one of the device frame parts and is provided with clamping jaws for engaging one end of the winding shaft.

18. The device according to claim 17, wherein the complete web roll is moveable into an area above a carriage, wherein the complete web roll is engaged by the carriage, and wherein the two pivot arms are subsequently lowered into a release position near the ground.

19. The device according to claim 17, wherein the pulling device is provided with a measuring device for detecting a transfer of the complete web roll onto the carriage, wherein an opening movement of the clamping jaws is controlled by the measuring device.

20. The device according to claim 17, further comprising a support module cooperating with the pulling device, wherein the support module engages from below the winding shaft that freely projects from the clamping jaws.

21. The device according to claim 1, , wherein the at least one central drive has a drive motor and an axially movable drive shaft whose driver located at an end face of the drive shaft receives a toothing provided on the winding shaft.

22. The device according to claim 1, wherein drive torques of the at least one central drive and of an auxiliary drive, respectively, are simultaneously controlled according to an operating position of the device.

23. The device according to claim 1, wherein the at least one linear guide supports the at least one central drive, wherein an advancing unit is connected to the control unit and is configured to move linearly the at least holding device and the at least one central drive.

24. The device according to claim 1, further comprising a pressing device comprising a contact roller and arranged in the area of the counter roller, wherein the pressing device moves the web with the contact roller against the winding shaft.

25. The device according to claim 24, wherein the pressing device is pivotably supported on the central transverse axis and wherein the contact roller in a rotational direction of the counter roller rests against a rolled-up web portion downstream of a winding gap between the counter roller and the winding shaft or the web wound onto the winding shaft.

26. The device according to claim 24, wherein the winding gap that is essentially adjustable as desired is 10 mm.

27. The device according to claim 24, wherein, when the counter roller rotates in a counterclockwise direction, the contact roller is placed against the winding shaft from below, wherein the contact roller during winding of the web onto the winding shaft is movable below a horizontal plane, and wherein, after removal of a complete web roll, the contact roller is pivoted back to the next winding shaft.

28. The device according to claim 24, wherein, when the counter roller rotates in the clockwise direction, the contact roller is placed against the winding shaft from above, wherein the contact roller during winding of the web onto the winding shaft is movable only above a horizontal plane, and wherein, after removal of a complete web roll, the contact roller is pivoted back into an initial position, and, subsequently, the next winding shaft is supplied in front of the contact roller.

* * * * *